US006702276B2

(12) United States Patent
Müller

(10) Patent No.: US 6,702,276 B2
(45) Date of Patent: Mar. 9, 2004

(54) APPARATUS FOR REDUCING A STACK OF FLAT, FLEXIBLE ARTICLES

(75) Inventor: Erwin Müller, Dürnten (CH)

(73) Assignee: Ferag AG, Hinwil (CH)

( * ) Notice: Subject to any disclaimer, the term of this patent is extended or adjusted under 35 U.S.C. 154(b) by 21 days.

(21) Appl. No.: 10/124,584

(22) Filed: Apr. 17, 2002

(65) Prior Publication Data

US 2002/0153653 A1 Oct. 24, 2002

(30) Foreign Application Priority Data

Apr. 18, 2001 (CH) ..... 0704/01

(51) Int. Cl.[7] ..... B65H 3/08
(52) U.S. Cl. ..... 271/101; 271/12
(58) Field of Search ..... 271/101, 12, 35

(56) References Cited

U.S. PATENT DOCUMENTS 1,876,606 A * 9/1932 Bushnell ..... 271/95
4,127,262 A 11/1978 Eberle et al.
5,106,070 A * 4/1992 Reist ..... 271/12
5,556,254 A * 9/1996 Darcy et al. ..... 414/798.1
5,702,099 A * 12/1997 Kohn ..... 271/101
5,785,310 A * 7/1998 Kohn ..... 271/13
6,332,607 B1 * 12/2001 Van Der Werff ..... 271/101

FOREIGN PATENT DOCUMENTS

CH 598 106 4/1978

* cited by examiner

*Primary Examiner*—Christopher P. Ellis
*Assistant Examiner*—Mark A. Deuble
(74) *Attorney, Agent, or Firm*—Alston & Bird LLP

(57) ABSTRACT

An apparatus for reducing a stack 1 of flat, flexible articles, in particular printed products, having bearing elements 3 which are moved along a continuous circulatory path U and, in a first sub-section A1 of the circulatory path U, U1, U2, form a stack rest 7. The apparatus has at least one separating element 5 which is capable of raising off a region 4*a* of the lowermost article 4 located in the stack 1 such that at least one of the bearing elements 3 can move in between the lowermost article 4 and the rest of the stack 1 and can separate off the lowermost article 4 from the rest of the stack 1 as it moves further. The apparatus further comprises a belt conveyor 8 which is arranged beneath the stack rest 7 and on which the articles come to rest once they have been separated off. The bearing elements 3 can be pivoted or displaced such that it is possible to change their position relative to the circulatory path U, U1, U2, to thereby allow the belt conveyor to extend forwardly without interference with the bearing elements.

16 Claims, 3 Drawing Sheets

APPARATUS FOR REDUCING A STACK OF FLAT, FLEXIBLE ARTICLES

BACKGROUND OF THE INVENTION

The invention relates to an apparatus for reducing a stack of flat, flexible articles by sequentially removing the articles from the underside of the stack.

A stack reducing apparatus of the described type is known from CH 598 106 and corresponding U.S. Pat. No. 4,127,262. The apparatus disclosed in these documents comprises a supporting apparatus made of spaced-apart rollers which are moved along a continuous circulatory path and can be rotated freely about their longitudinal axis. The rollers form, in a portion of the supporting apparatus, a rest in the form of a roller pathway upon which a stack of sheet-like articles rests. The rollers are moved through beneath the stack, with the stack always resting on a plurality of rollers. A cyclically driven suction element has access to the stack from beneath, through the interspaces between two rollers, and raises off in each case one corner of the currently lowermost product from the rest of the stack. At least the following roller of these two rollers, as seen in the direction of circulation of the continuously moving roller pathway, moves into the interspace between the raised-off corner and the rest of the stack and thus peels off the lowermost product from the rest of the stack. The stack is fixed laterally by supporting elements. The drawn-off product comes to rest on a belt conveyor arranged beneath the stack rest. The deposited products form an imbricated formation, which is transported away continuously.

The problem with the above described apparatus is that the space taken up by the rollers constitutes a cylinder casing or "wall" having a fixed cross-sectional surface area and a certain width which is at least equal to the length of the rollers. This space is thus blocked by the roller pathway or the supporting apparatus, and it is thus necessary for the belt conveyor to be arranged obliquely in relation to the circulatory path of the rollers and to route the removed articles laterally out of the region of the supporting apparatus. The overall arrangement, comprising the supporting apparatus and the belt conveyor, thus have a considerable lateral extent, which greatly exceeds the stack width. It is not possible for the stack-reducing apparatus to be realized in a compact manner. If, furthermore, the intention is to produce on the belt conveyor an imbricated formation with the edges of the products running perpendicularly and/or parallel to the removal direction, it is necessary to orient the stack on the stack rest obliquely in relation to the rollers. As a result, shortly prior to being deposited on the belt conveyor, an article is only retained at one corner. When the article is deposited, it is thus possible, in particular at high stack-reduction speeds, for this to result in twisting and thus in undesirable mechanical loading of the article and in a non-uniform imbricated formation.

An object of the invention is to develop an apparatus for reducing a stack of flat, flexible articles of the above described type such that the lateral extent of the apparatus is minimized.

It is a further object of the invention to render it possible for the articles, even at high speeds, to be transferred reliably to the belt conveyor in a defined orientation.

SUMMARY OF THE INVENTION

The above and other objects and advantages of the invention are achieved by the provision of an apparatus of the described type wherein the product stack is supported from beneath by a plurality of bearing elements, which slide through beneath the stack. The bearing elements form part of a supporting apparatus, and they are preferably fastened, at one end, on a conveying element which is moved along a continuous circulatory path. In the region of the stack rest, the bearing elements preferably run horizontally and parallel to one another. It is particularly preferable for their axes to be located in a common horizontal plane or slightly curved surface which constitutes the stack rest.

The bearing elements are preferably rollers which can be rotated freely about their longitudinal axis and roll with a low level of friction on the articles which are to be removed. The bearing elements are configured and driven, for example, as is described in CH 598 106 and U.S. Pat. No. 4,127,262.

According to the invention, the bearing elements can be pivoted or displaced such that it is possible to change their position or orientation relative to the circulatory path. The circulatory path referred to here is the circulatory path of the bearing points of the bearing elements, of which the position relative to the conveying element does not change. The circulatory plane referred to is the plane in which the circulatory path is located. If the circulatory path is a three-dimensional curve which is not located in one plane, the circulatory plane referred to is the plane by which the three-dimensional curve can be approximated locally.

The space covered by the rollers is formed, according to the invention, such that the removal arrangement can be routed out of the region of the supporting apparatus in a space-saving manner. At the location where the belt conveyor is spaced apart from the circulatory path to the smallest extent, i.e. where the belt conveyor extends through the circulatory path when viewed in side elevation, the rollers are pivoted or displaced and thus free the path for the belt conveyor. The belt conveyor may be arranged directly beneath the stack rest. The apparatus according to the invention may thus be of very compact design.

In a further preferred embodiment, the bearing elements are oriented parallel to the leading and/or trailing edge of the stack. This is because the invention renders it unnecessary for the stack to be positioned on the stack rest obliquely in relation to the bearing elements. This means that a separated-off article is always retained over its entire width until it is separated off completely. When it is deposited on the belt conveyor, it is not twisted, even at relatively high stack-reduction speeds.

The supporting arrangement may be designed in one or two parts. The single-part version has a pathway made of bearing elements fastened pivotably at one end on a conveying element. In order for the stack to be well supported, said bearing elements may be supported by a rail, at their free end, in the region of the stack rest. The separating element has access to the lowermost product, through the interspace between two bearing elements, for example as in CH 598 106 and U.S. Pat. No. 4,127,262. It is operated cyclically in adaptation to the spacing between, and the speed of, the bearing elements.

The two-part configuration has two roller pathways, of which the rollers or bearing elements are located in a common plane in the region of the stack rest. The bearing elements of the first and of the second roller pathway are each fastened on a respective first and second conveying element and can be displaced or pivoted relative thereto. The belt conveyor is preferably arranged between the conveying elements.

An example of such a two-part roller pathway is described in the application PCT/CH00/00530, which was not published before the priority date. The arrangement of, and means of controlling, the rollers of which use is made in said application may also be used for the present apparatus.

BRIEF DESCRIPTION OF THE DRAWINGS

Exemplary embodiments of the invention are described hereinbelow and illustrated in the drawing, in which, purely schematically.

DETAILED DESCRIPTION OF THE PREFERRED EMBODIMENTS

Figure 1:
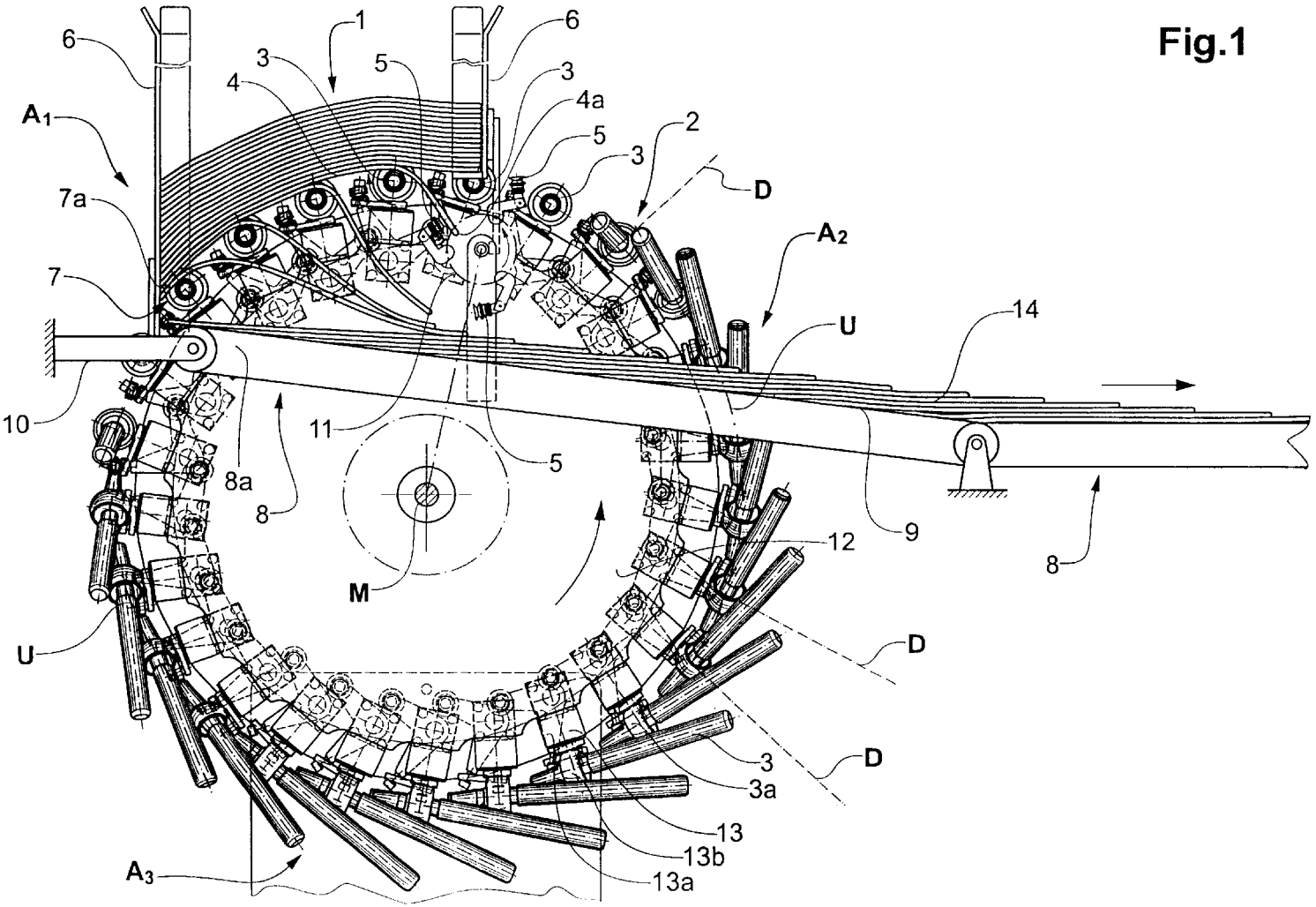
FIG. 1 is a side elevation view of an apparatus according to the invention for stack-reduction purposes.

FIG. 1 is a side elevation view of an apparatus according to the invention for reducing a stack 1 of flat articles. The apparatus comprises a supporting apparatus 2 which has a multiplicity of rollers 3. The rollers are fastened on a wheel 12 via retaining elements 13. The wheel serves as a conveying element for the rollers 3. During movement of the wheel 12, the end (bearing region) 3*a* of a roller, said end being retained by the retaining element 13, is moved along a continuous circulatory path U, which in this case is circular but may also be shaped in some other way. The circulatory path U is located in a plane which in this case is oriented vertically. The rollers 3 can be pivoted relative to the wheel 12 by virtue of the retaining element 13 having a base 13*a*, which is connected firmly to the wheel, and a clamp 13*b*, which is connected rotatably to the base and retains the roller 3 in the bearing region 3*a*. The axis of rotation D of the pivoting movement runs essentially in the radial direction or secant direction, i.e. in this case it does not pass directly through the center point M of the wheel 12. The rollers 3 are pivoted mechanically preferably by a guide control means. For this purpose, the control guide (not illustrated here) interacts in a suitable manner with the retaining element 13 or the roller 3.

According to the invention, the rollers form, over a sub-section A1 of the circulatory path U, a rest 7 for the stack 1. For this purpose, the rollers, in this sub-section, are oriented parallel to one another, preferably horizontally and/or perpendicularly to the circulatory plane. In the present case, the stack rest 7 is curved in accordance with the circulatory path U. The stack 1 rests on the roller pathway formed by the rollers 3 and is retained in position laterally by vertical boundary elements 6. These preferably define a shaft, of which the dimensions can be adapted to the format of the articles which are to be processed.

The stack 1 is reduced from beneath by virtue of a separating element 5 acting on the leading edge 4*a* of the article 4. The leading edge 4*a* is drawn downward, for example by virtue of the separating element 5 attaching by suction the lowermost article 4 in the operating region of the separating element. In the present case, three separating elements 5 designed as suckers are arranged on a wheel 11. A roller 3 moves into the resulting interspace and, as it moves further, peels off from the stack 1 the article which has been bent away by the separating element. At any point in time, the stack 1 is supported from beneath by a plurality of rollers 3. It is not necessary for an article to be peeled off completely before the separating element 5 has access to a further article. In the present case, a plurality of articles are still connected to the stack downstream, as seen in the movement direction of the rollers, whereas their upstream edges have already been bent away from the stack and are separated from one another by rollers 3.

As the stack is reduced, the rollers 3 run parallel to the leading and/or trailing edge of the stack 1. At any point in time, the articles are thus supported over their entire width by at least one roller and do not twist as they are transferred to the belt conveyor 8.

Figure 2:
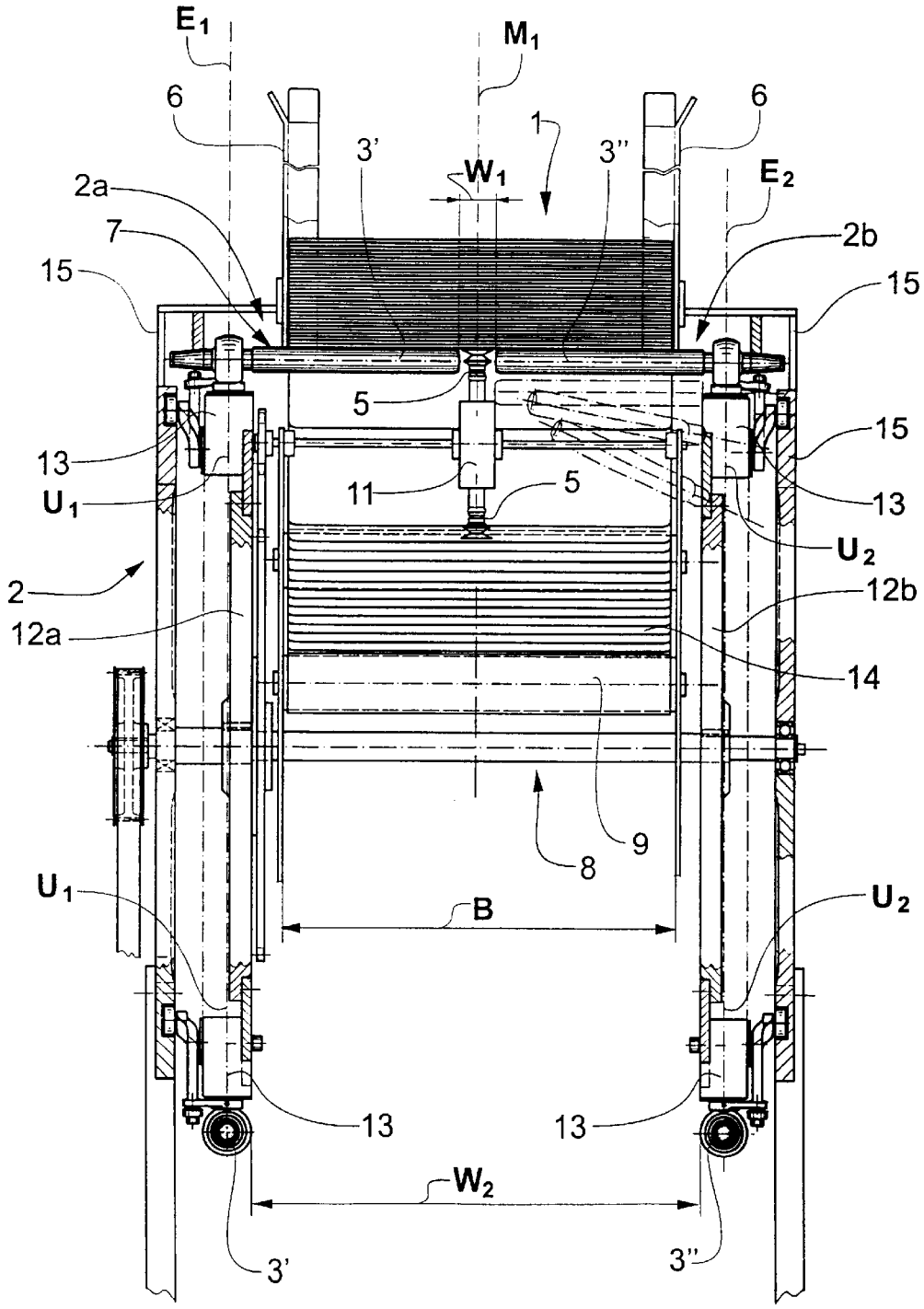
FIG. 2 shows a front view, counter to the removal direction, of an apparatus according to the invention with a supporting apparatus with a two-part roller pathway.
Figure 3:
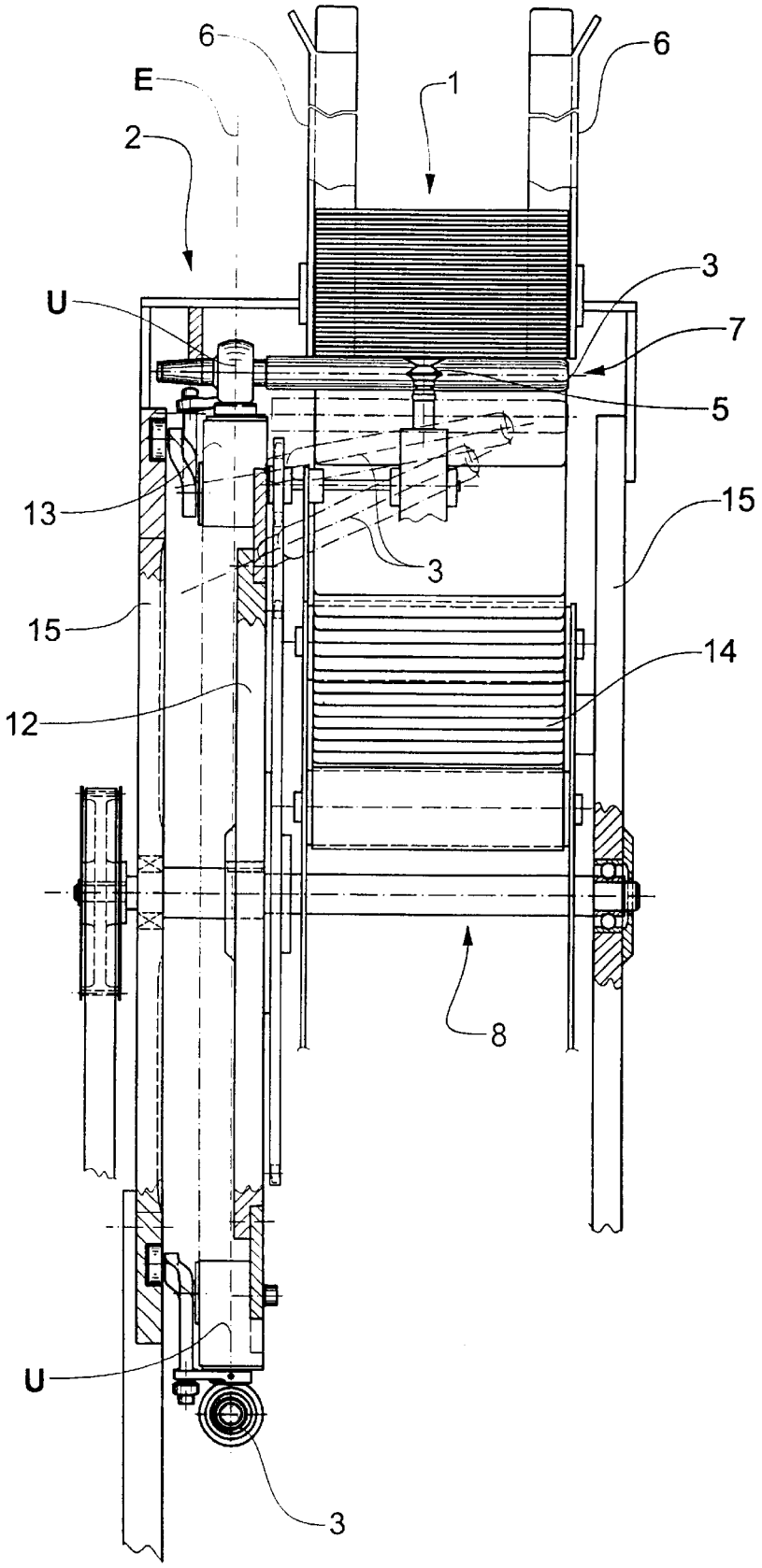
FIG. 3 shows a front view of an apparatus according to the invention with a supporting apparatus with a single-part roller pathway.

The rollers 3 can be rotated freely about their longitudinal axis and roll on the underside of the stack or between the bottom articles. It is further possible to provide means for driving the rollers 3 in rotation in the region of the stack rest 7, said means acting, for example, on the conically formed end of the rollers 3. The friction between the rollers 3 and the articles may be further reduced as a result. Such static friction bars 20, which set the rollers in rotation by friction as they move along the circulatory path, are illustrated in FIGS. 2 and 3.

The belt conveyor 8 has a conveying belt 9 which is oriented parallel to the plane of the circulatory path U. The rear end 8*a* of the belt conveyor 8 is located in the immediate vicinity of the movement path of the rollers beneath the stack rest 7. The spacing and the lateral suspension 10 of the conveying belt 9 are selected such that the rollers 3 can move past the rear end 8*a*. The dropping height of a removed article, i.e. the spacing between the rear end 8*a* of the belt conveyor 8 and the rear end 7*a* of the stack rest 7 is thus essentially bounded in the downward direction by the diameter of a roller 3. It may advantageously be kept small, as a result of which the articles can be reliably deposited directly on the conveying belt 9. Complicated intermediate conveyors may be dispensed with.

According to the invention, at least at the location where the belt conveyor 8 crosses the circulatory path U, as seen in side elevation view of the circulatory plane, the rollers are pivoted and thus free the path for the belt conveyor 8. In this sub-section A2 of the circulatory path, the rollers 3 are located at an angle of less than 90° to the circulatory plane. Specifically, they may be located essentially in the circulatory plane. It is thus possible for the belt conveyor 8 to be routed out of the region of the circulatory path U in the immediate vicinity of the wheel 12. It may also cross over the circulatory path twice, e.g. to the right and left of the stack 1, for the purpose of conveying products through beneath the stack (not illustrated here).

In the present case, the rollers 3 are pivoted in the bottom region A3 of the circulatory path U such that they are located in the plane of a circulatory path. The supporting apparatus 2 thus has a particularly small transverse extent in this bottom region A3. In principle, however, it is sufficient for the rollers only to be moved out of the way in the region A2, in which the belt conveyor 8 crosses over. For this purpose, the rollers may be displaced linearly or, as in this case, rotated, it also being possible for a pivoting movement of less than 90° to be sufficient.

FIG. 2 is a front view of an apparatus according to the invention with a supporting arrangement 2 composed of a first and a second roller system 2*a*, 2*b*. The arrangement is mirror-symmetrical to a center plane M1. The illustration according to FIG. 1 corresponds to a section along this center plane M1.

First rollers 3' are fastened on a first vertical wheel 12*a* by a retaining element 13 and are moved along a circulatory path U1. In a mirror-symmetrical arrangement, second rollers 3" are fastened on a second wheel 12*b* by retaining elements 13. In the top region of the supporting apparatus 2, the rollers 3', 3" are arranged horizontally and coaxially in pairs in each case. In the top region of the apparatus, the rollers 3', 3" form a rest 7 for the stack 1. The latter is bounded laterally by supporting elements 6.

A separating element 5 has access to the stack 1 from beneath between a first and a second roller 3', 3", the end surfaces of the rollers being spaced apart from one another (spacing W1) for the through-passage of the separating element 5. By virtue of the following pair of rollers, the product is separated off and drops onto the belt conveyor 8. This produces an imbricated formation 14. The belt conveyor 8 is arranged between the first wheel 12*a* and the second wheel 12*b* of the supporting apparatus 2. According to the invention, as they move along their circulatory path U1, U2, the respective rollers 3', 3" are pivoted out of their position perpendicular to the respective circulatory plane E1, E2 into an orientation in the respective circulatory plane E1, E2 or at an angle of less than 90° thereto. It is thus possible for the belt conveyor to be routed out of the region bounded by the circulatory paths U1 and U2 between the circulatory planes E1 and E2. The distance W2 between the first and second rollers 3' and 3", respectively, in the region in which the removal arrangement 8 is routed out corresponds at least to the width B of the belt conveyor. Such a stack-reducing apparatus is compact and narrow.

The apparatus shown with two mirror symmetrical roller arrangements has the advantage that quick adaptation to different formats is possible by virtue of, for example, the spacing between the circulatory planes E1 and E2 or the wheel 12*a*, 12*b* being increased or decreased. In this case, the mechanical stability of the apparatus is straightforwardly maintained. A further advantage is that, at any point in time, the separating element 5 can have access to the stack from beneath and there is no need for any synchronization for the movement of the rollers 3', 3".

FIG. 3 shows a further example of an apparatus according to the invention, this time with a supporting apparatus 2 with a single roller pathway. The construction of the supporting apparatus 2 corresponds essentially to the construction of the left-hand or right-hand part of the supporting apparatus according to FIG. 2. FIG. 1 corresponds to a side view of this apparatus.

Rollers 3 are fastened on a wheel 12 via retaining elements 13 and can be pivoted relative to said wheel. In the top part of the apparatus, the rollers 3 form the stack rest 7. In the bottom part, the rollers are pivoted out of the way, with the result that the removal arrangement 8 can run parallel to the wheel 12 or to the circulatory plane E. A supporting framework 15, in which the wheel 12 is mounted, is provided for mechanical support. The removal arrangement 8 is preferably also supported on the supporting framework 15. The separating element 5 has access to the underside of the stack 1 through the interspaces between two rollers 3.

In the present examples, the rollers are pivoted about an axis running essentially normal to the circulatory paths U or U1, U2. It also possible to realize the pivoting operation about another axis. Pivoting about an axis running tangentially to the circulatory path is described and illustrated, for example, in international Patent Application PCT/CH00/00530, which was not published before the priority date. This document also describes further possibilities of securing the rollers on the supporting apparatus or on a conveying element, it likewise being possible for these possibilities to be used within the scope of the present invention. Instead of the rollers, it is also possible to use other bearing elements, e.g. bars, spindles or the like.

What is claimed is:

1. An apparatus for reducing a stack of flat, flexible articles, comprising a plurality of bearing elements each defining a longitudinal axis and being mounted for movement along a continuous circulatory path such that in a first sub-section of the circulatory path the bearing elements form a rest adapted to receive a stack of the articles thereupon, at least one separating element for raising off a region of the lowermost article located in the stack from the remainder of the stack and such that at least one following bearing element as seen in the direction of circulation is moved in between the raised off article and the remainder of the stack and acts to separate the raised of f article from the remainder of the stack as it moves further, a belt conveyor positioned beneath the stack rest for receiving the articles after being separated from the stack, and wherein the bearing elements are each also mounted for pivotal movement about a pivotal axis which is substantially perpendicular to their respective longitudinal axis.

2. The apparatus as defined in claim 1 wherein during movement along said first sub-section of the circulatory path, the bearing elements are oriented with their longitudinal axes parallel to the leading and trailing edges of a stack of articles positioned upon said rest.

3. The apparatus as defined in claim 1, wherein the bearing elements comprise rollers which can be rotated freely about their longitudinal axes.

4. The apparatus as defined in claim 1, wherein the bearing elements are pivoted such that the belt conveyor is capable of conveying the articles in the immediate vicinity of the circulatory path and out of the region bounded by the circulatory path, with the circulatory path running in a plane and the belt conveyor running essentially parallel thereto.

5. The apparatus as defined in claim 1, wherein a number of first bearing elements are moved along a first circulatory path and a number of second bearing elements are moved along a second circulatory path, the first and the second circulatory paths being parallel to one another at least in the region of the stack rest.

6. The apparatus as defined in claim 5, wherein the first and second bearing elements are spaced apart from one another in the region of the stack rest so as to form a gap running parallel to the circulatory paths and the separating element is positioned to have access to the stack in the region of the gap.

7. The apparatus as defined in claim 5, wherein the spacing between the first and second bearing elements is increased by the pivoting of the bearing elements such that the belt conveyor, without being obstructed mechanically by the bearing elements, can be routed out of the region bounded by and between the first and the second circulatory paths.

8. The apparatus as defined in claim 5, further comprising means for providing a variable spacing between the first and the second circulatory paths in the region of the stack rest, for adaptation of the width of the stack rest to the stack width.

9. The apparatus as defined in claim 1, further comprising means for cyclically moving the at least one separating element such that it acts on the lowermost article between two successive bearing elements, as seen in the direction of circulation.

10. The apparatus as defined in claim 1, wherein the continuous circulatory path lies in a circulatory plane and wherein the bearing elements, in the first sub-section of the circulatory path are oriented horizontally and substantially perpendicular to the circulatory plane and, in a second sub-section of the circulatory path are oriented less than 90° to the circulatory plane.

11. The apparatus as defined in claim 10 wherein the belt conveyor runs in a direction essentially parallel to said circulatory plane and so as to cross the circulatory path when viewed in side elevation in the second sub-section of the circulatory path.

12. The apparatus as defined in claim 11 wherein in the second sub-section of the circulatory path where the belt conveyor crosses the path, the bearing elements are oriented to lie substantially in said circulatory plane.

13. The apparatus as defined in claim 1, wherein the continuous circulatory path lies in a circulatory plane and wherein the pivotal axes of the bearing elements extend essentially radially or along a secant to the circulatory path so that the bearing elements are pivotable between an orientation essentially normal to the circulatory plane and an orientation essentially tangential to the circulatory path.

14. The apparatus as defined in claim 1, wherein the continuous circulatory path lies in a circulatory plane and wherein the pivotal axes of the bearing elements extend essentially tangentially or along a secant to the circulatory path so that the bearing elements are pivotable between an orientation essentially normal to the circulatory plane and an orientation essentially radial to the circulatory path.

15. The apparatus as defined in claim 1 wherein the bearing elements are fastened on a conveying element which is moved along the circulatory path.

16. The apparatus as defined in claim 1 further comprising a stack supporting frame for supporting a stack of flat, flexible articles so as to rest upon said rest formed by said bearing elements.

* * * * *